US011885146B2

(12) United States Patent
Martin

(10) Patent No.: US 11,885,146 B2
(45) Date of Patent: Jan. 30, 2024

(54) COLLARS FOR USE IN EITHER DRIVING POSTS INTO OR REMOVING POSTS FROM THE GROUND, AND RELATED METHODS

(71) Applicant: Thomas Martin, Ridgecrest, CA (US)

(72) Inventor: Thomas Martin, Ridgecrest, CA (US)

( * ) Notice: Subject to any disclaimer, the term of this patent is extended or adjusted under 35 U.S.C. 154(b) by 0 days.

(21) Appl. No.: 17/567,608

(22) Filed: Jan. 3, 2022

(65) Prior Publication Data

US 2022/0120114 A1 Apr. 21, 2022

Related U.S. Application Data

(60) Continuation of application No. 16/576,316, filed on Sep. 19, 2019, now Pat. No. 11,214,977, which is a division of application No. 14/834,414, filed on Aug. 24, 2015, now abandoned.

(51) Int. Cl.
*E04H 17/26* (2006.01)
*E02D 7/00* (2006.01)

(52) U.S. Cl.
CPC ..... *E04H 17/263* (2013.01); *E02D 7/00* (2013.01); *E04H 17/265* (2013.01)

(58) Field of Classification Search
CPC ..... E01F 9/70; E02D 7/00; E04H 17/263; E04H 17/265
USPC ..... 173/90; 254/30
See application file for complete search history.

(56) References Cited

U.S. PATENT DOCUMENTS 3,499,497 A * 3/1970 Moore ..... E04H 17/263 175/135
3,670,468 A * 6/1972 Cordell, Sr. ..... E02D 27/42 52/298
3,762,687 A * 10/1973 De Rome ..... B66C 1/62 294/92
4,040,601 A * 8/1977 Boardman ..... B66F 19/00 254/133 R
4,213,560 A * 7/1980 Hall ..... A47G 29/1216 248/156

(Continued)

OTHER PUBLICATIONS

Geometry—basic definition of cylinder—Mathematics Stack Exchange. URL https://math.stackexchange.com/questions/1837977/basic-definition-of-cylinder (Year: 2023).*

(Continued)

*Primary Examiner* — Valentin Neacsu
(74) *Attorney, Agent, or Firm* — Harness, Dickey & Pierce, P.L.C.

(57) ABSTRACT

A collar is provided that can be used to either drive posts into the ground or remove posts from the ground. The collar includes a first portion defining a post opening adapted for coupling about a post, and a second portion coupled to the first portion. The second portion includes a receiver adapted for receiving a tool for use in driving the post into the ground when the first portion is coupled about the post. The first portion defines an obtuse angle with respect to the second portion. The collar is configured to be positioned in a first orientation about a post when used to drive the post into the ground, and a second orientation, rotated approximately 180 degrees relative to the first orientation, when used to remove a post from the ground.

13 Claims, 11 Drawing Sheets

(56) References Cited

U.S. PATENT DOCUMENTS 4,429,849 A * 2/1984 Maier ..... E04G 21/1833 248/156
4,979,724 A * 12/1990 Williams ..... E04H 17/08 403/374.2
5,009,394 A * 4/1991 Marshall ..... E01F 9/623 254/30
5,368,277 A * 11/1994 Moss ..... E04H 17/265 254/30
5,439,201 A * 8/1995 Landreville ..... E04H 17/1413 52/712
5,494,117 A * 2/1996 Aldridge ..... E02D 7/10 212/253
5,632,464 A * 5/1997 Aberle ..... E01F 9/685 52/298
5,681,030 A * 10/1997 Nall ..... E04H 17/265 254/131
5,713,559 A * 2/1998 McClarin ..... E04H 17/265 254/129
5,855,358 A * 1/1999 Witter ..... E04H 17/265 254/25
6,131,884 A * 10/2000 Broussard ..... E04H 17/265 254/129
6,302,376 B1 * 10/2001 Williams ..... E04H 17/265 254/30
6,347,672 B1 * 2/2002 Reardon ..... E02D 7/04 173/132
6,505,817 B1 * 1/2003 Witter ..... E04H 17/265 254/25
6,772,565 B1 * 8/2004 Schiltz ..... E04H 17/265 52/156
6,866,248 B1 * 3/2005 Sears ..... E04H 17/265 254/30
6,902,152 B1 * 6/2005 Clifford ..... E04H 17/1413 256/65.01
6,978,983 B1 * 12/2005 Sclease ..... E04H 17/265 254/30
7,185,880 B1 * 3/2007 McCray ..... E02D 9/02 254/30
7,597,156 B1 * 10/2009 Reid ..... E04H 17/263 173/171
7,878,482 B2 * 2/2011 Hernandez, Jr. ..... B66F 3/30 254/93 H
7,963,051 B2 * 6/2011 Ford ..... E04H 17/265 37/195
8,465,004 B1 * 6/2013 Fly ..... B25B 27/02 111/95
8,555,563 B1 * 10/2013 Wong ..... A01G 17/16 52/119
8,608,132 B1 * 12/2013 Allen ..... E04H 17/26 254/130
11,214,977 B2 * 1/2022 Martin ..... E04H 17/265
2002/0179893 A1 * 12/2002 Salisbury ..... F24S 25/10 256/1
2004/0026095 A1 * 2/2004 Kleinert ..... E04H 17/263 173/90
2005/0145761 A1 * 7/2005 Wooten ..... E04H 17/263 248/156
2005/0199865 A1 * 9/2005 Wink ..... E04H 17/08 256/24
2006/0180719 A1 * 8/2006 Cooper ..... E04H 12/2215 248/156
2006/0260829 A1 * 11/2006 Kleinert ..... E02D 7/04 173/90
2007/0018144 A1 * 1/2007 Saavedra ..... E04H 17/265 254/30
2007/0090332 A1 * 4/2007 Mensi ..... E04H 17/265 254/30
2007/0181320 A1 * 8/2007 Mason ..... B25D 1/16 173/90
2008/0149786 A1 * 6/2008 Bradley ..... E04H 12/2253 248/121
2008/0149791 A1 * 6/2008 Bradley ..... F16B 9/052 248/220.21
2009/0152783 A1 * 6/2009 Sigler ..... E04H 17/26 269/287
2009/0178818 A1 * 7/2009 McNeill ..... E04H 17/263 173/90
2009/0315005 A1 * 12/2009 Hironaga ..... E04H 17/265 254/132
2010/0260590 A1 * 10/2010 Ford ..... E04H 17/265 414/815
2010/0301289 A1 * 12/2010 Rivard ..... E04H 17/265 254/30
2011/0062398 A1 * 3/2011 Ring-Gjerde ..... E04H 17/265 294/92
2011/0240321 A1 * 10/2011 Palmlund ..... E02D 13/00 173/90
2012/0074362 A1 * 3/2012 Sanchez ..... E04H 17/265 29/426.1
2012/0279737 A1 * 11/2012 Trethewey ..... E21B 19/00 173/29
2013/0099184 A1 * 4/2013 McNeill ..... E04H 17/263 254/30
2014/0117295 A1 * 5/2014 Shaw ..... E04H 17/265 254/30
2016/0222695 A1 * 8/2016 Hoovler ..... E04H 17/265
2017/0058559 A1 * 3/2017 Martin ..... E04H 17/263
2020/0011084 A1 * 1/2020 Martin ..... E02D 7/00
2022/0120114 A1 * 4/2022 Martin ..... E02D 7/00

OTHER PUBLICATIONS

Cylinder Definition & Meaning—Merriam-Webster. URL https://www.merriam-webster.com/dictionary/cylinder (Year: 2023).*
Three-dimensional study of flow past a square cylinder at low Reynolds numbers by AK Saha et al. , International Journal of Heat and Fluid Flow 24 (2003) 54-66 (Year: 2003).*
Integral Definition & Meaning—Merriam-Webster—URL https://www.merriam-webster.com/dictionary/integral (Year: 2023).*

* cited by examiner

COLLARS FOR USE IN EITHER DRIVING POSTS INTO OR REMOVING POSTS FROM THE GROUND, AND RELATED METHODS

CROSS-REFERENCE TO RELATED APPLICATION

This application is a continuation of U.S. patent application Ser. No. 16/576,316, filed on Sep. 19, 2019, which is a divisional of U.S. patent application Ser. No. 14/834,414, filed on Aug. 24, 2015. The entire disclosure of each of the above applications is incorporated herein by reference.

FIELD

The present disclosure generally relates to collars that can be used in connection with driving posts into the ground and in connection with removing posts from the ground, and methods related thereto.

BACKGROUND

This section provides background information related to the present disclosure which is not necessarily prior art.

Steel fence posts (e.g., T-posts, etc.) are often driven into the ground to construct fences. The posts may include studs located along the posts for attaching wire or other fence material. The posts are generally driven into the ground using a post driver (or pounder), which has a cylinder that, for each post that is to be driven, is placed over an end of the post and repeatedly moved up and down to drive the post into the ground. Separately, when desired, the posts can be removed from the ground by digging the posts out or by manually pulling directly on the posts.

SUMMARY

This section provides a general summary of the disclosure, and is not a comprehensive disclosure of its full scope or all of its features.

Exemplary embodiments of the present disclosure generally relate to collars for use in either driving posts into the ground or removing posts from the ground. In one exemplary embodiment, such a collar generally includes a first portion defining a post opening adapted for coupling about a post, and a second portion coupled to the first portion. The second portion defines a receiver adapted for receiving a driving tool for use in driving the post into the ground when the first portion is coupled about the post. The first portion defines an obtuse angle with respect to the second portion. In various aspects, the first and second portions are integrally formed and generally define a body of the collar.

Exemplary embodiments of the present disclosure also generally relate to methods of using collars to either drive T-shaped posts into the ground or remove T-shaped posts from the ground. In one exemplary embodiment, such a method generally includes, when driving a T-shaped post into the ground, coupling the collar to the T-shaped post in a first orientation so that a post opening of a first portion of the collar extends about the T-shaped post and a slot portion of the post opening receives a rib extension of the T-shaped post and so that a side of the first portion of the collar, disposed generally opposite the slot portion of the post opening, is adjacent a stud of the T-shaped post, and then applying a driving force to a second portion of the collar, for use in driving the T-shaped post into the ground, so that an axis of the driving force is offset from a longitudinal axis of the T-shaped post. The method also generally includes, when removing the T-shaped post from the ground, coupling the collar to a T-shaped post in a second orientation, rotated approximately 180 degrees from the first orientation, so that the post opening of the first portion of the collar extends about the T-shaped post and the slot portion of the post opening receives the rib extension of the T-shaped post and so that the side of the first portion of the collar, disposed generally opposite the slot portion of the post opening, is adjacent a stud of the T-shaped post, and then applying an extracting force to the second portion of the collar, for use in removing the T-shaped post into the ground.

Exemplary embodiments of the present disclosure also generally relate to assemblies for use in either driving posts into the ground or for use in removing posts from the ground. In one exemplary embodiment, an assembly generally includes a collar of the present disclosure and one or more of a tool adapted for driving the post into the ground and a tool for use in removing the post from the ground.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
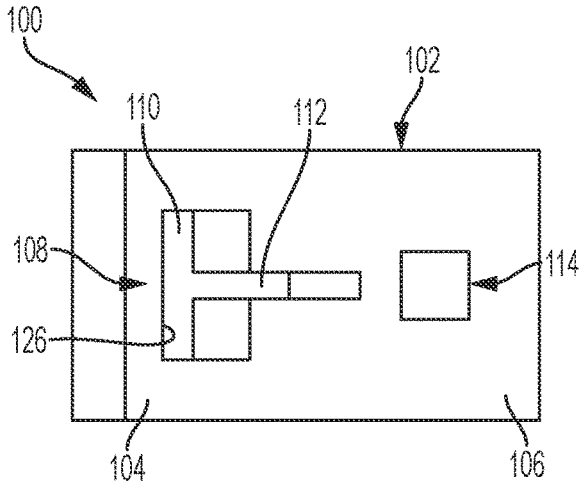
FIG. 1 is a top view of an exemplary embodiment of a collar according to the present disclosure and suitable for use in either driving posts into the ground or removing posts from the ground.
Figure 2:
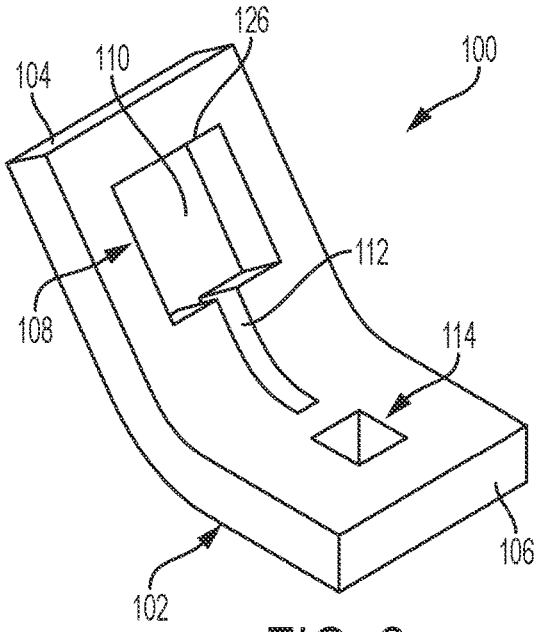
FIG. 2 is a perspective view of the collar of FIG. 1.
Figure 3:
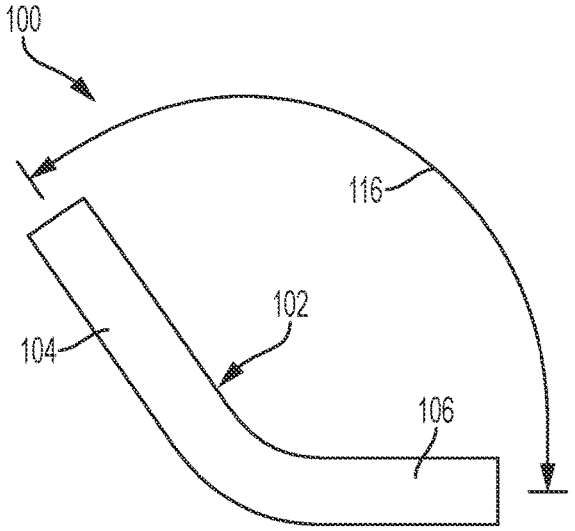
FIG. 3 is a side view of the collar of FIG. 1.
Figure 4:
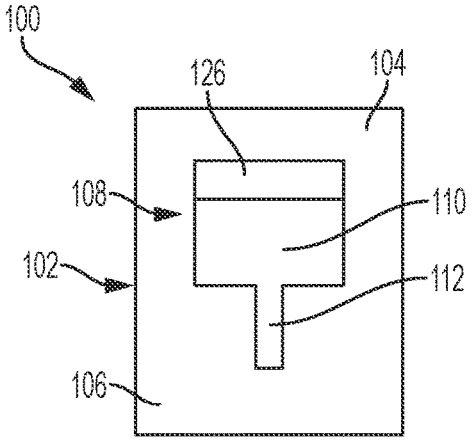
FIG. 4 is a front view of the collar of FIG. 1.
Figure 5:
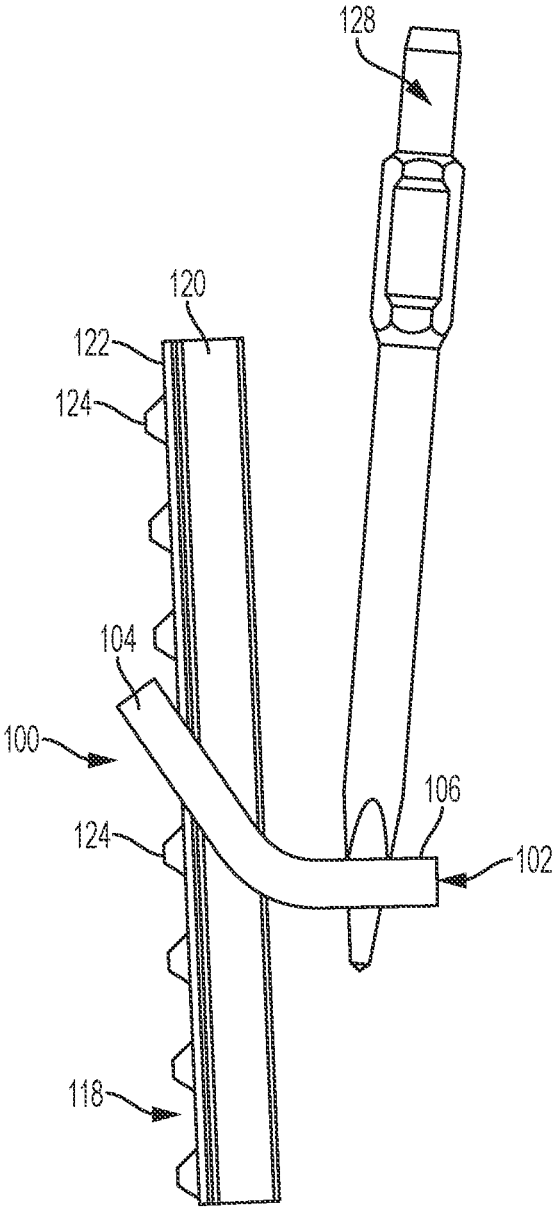
FIG. 5 is a side view of the collar of FIG. 1, with a first portion of the collar shown installed to a T-shaped post in a first orientation and with a driving tool shown coupled to a second portion of the collar for use in driving the T-shaped post into the ground.
Figure 6:
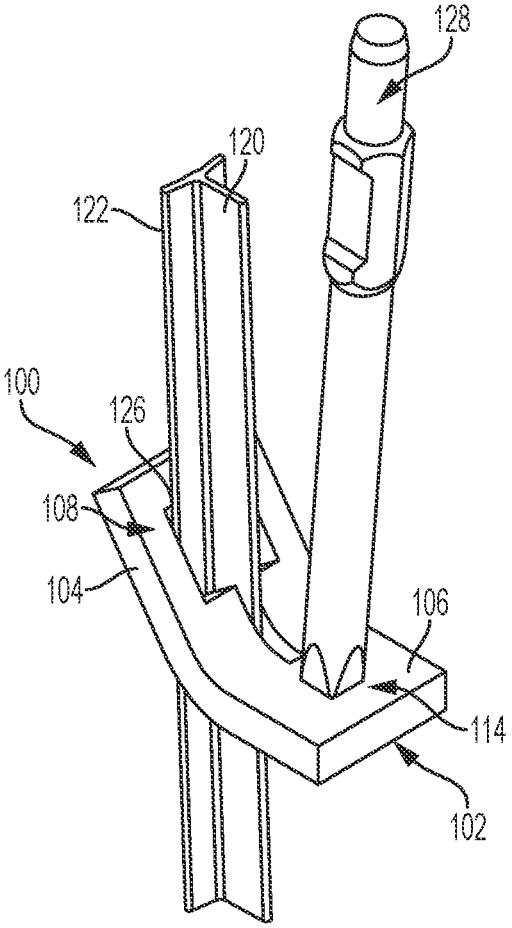
FIG. 6 is a perspective view of the assembly of FIG. 5.

Exemplary embodiments of the present disclosure generally relate to collars for use in either driving posts into the ground (or other desired location) or removing posts from the ground (or other location). The collars may be used with any desired types of posts. For example, the collars may be used with steel posts, wood posts, T-shaped posts (also called T-posts), Y-shaped posts, star-shaped posts, fence posts, poles, pilings, vertical piles, etc. In addition, the collars can be used with posts in connection with any suitable applications (e.g., for constructing fences, posting signs, constructing retention walls, constructing piers, etc.).

In connection with using the collars to drive posts into the ground, the collars may be placed about the posts (e.g., over end portions of the posts, around sides of the posts, etc.), and driving forces may then be applied to the collars using desired tools (e.g., jackhammers, etc.) to drive the posts into the ground. In various embodiments, the collars are configured so that when they are coupled about the posts, axes of the tools along which the driving forces are applied for driving the posts into the ground are offset from longitudinal axes of the posts. This provides room to operate the tools adjacent the posts. Further, in some of these embodiments, the axes of the tools and the longitudinal axes of the posts are not parallel (e.g., the axes may converge, etc.). This may help facilitate driving of the posts into the ground without bending the posts, etc.

In connection with using the collars to remove posts from the ground, the collars may again be placed about the posts (e.g., over end portions of the posts, around sides of the posts, etc.), and extracting forces may then be applied to the collars using desired tools (e.g., hooks, jacks, etc.) to remove the posts from the ground. In various embodiments, the same collars may be used to both drive posts into the ground and to remove posts from the ground (although this is not required). For example, the collars may be coupled about posts in a first orientation and used to drive the posts into the ground. The collars may then be rotated, or flipped over, about 180 degrees to a second orientation and then used to remove posts from the ground (e.g., the same posts, different posts, etc.).

In various embodiments, the collars may also be easily, quickly and efficiently positioned about posts, both when being used to drive posts into the ground and when being used to remove posts from the ground. For example, the collars can be slid over end portions of the posts, around sides of the posts, etc., to desired locations and then immediately used to either drive the posts into the ground or remove the posts from ground. Further in these embodiments, the collars can be adjusted along the posts to different locations so that, as the posts are driven into the ground or removed from the ground, the tools being used can be maintained at a comfortable position adjacent the posts for operation. Moreover, the collars can help facilitate quick and easy driving and/or removal of multiple posts. For example, once initially installed (and used to either drive posts into the ground or remove posts from the ground), the collars can be easily removed from the posts and then quickly used again to drive or remove additional posts.

With reference now to the drawings, FIGS. 1-12 illustrate an exemplary embodiment of a collar 100 including one or more aspects of the present disclosure. The collar 100 can be used to drive posts into the ground, and can also be used to remove (or extract) posts from the ground. As used herein, posts (with which the collar 100 can be used) may include any suitable posts including, for example, steel posts, wood posts, T-shaped posts (also called T-posts), Y-shaped posts, star-shaped posts, fence posts, poles, pilings, vertical piles, etc. In addition, the collar 100 can be used with posts in connection with any suitable applications (e.g., for constructing fences, posting signs, constructing retention walls, constructing piers, etc.).

As shown in FIGS. 1-4, the collar 100 generally includes a body 102 having an upper portion 104 (broadly, a first portion) and a lower portion 106 (broadly, a second portion). In general, the upper portion 104 may be viewed as coupled to the lower portion 106. In the illustrated embodiment, the upper portion 104 and the lower portion 106 are integrally formed as a single structure to define the body 102. In other embodiments, however, collars may include separate upper and lower portions coupled together via mechanical fasteners, welds, etc. In addition, the collar 100 can be formed from any suitable material including, without limitation, metals such as iron, steel, alloys, etc.

The upper portion 104 of the collar 100 defines a post opening 108 adapted for coupling about a post. The post opening 108 extends through the body 102 of the collar 100 and includes a main portion 110 that is generally square in shape, and a slot 112 extending generally away from the main portion 110 and generally toward the lower portion 106 of the collar 100. The post opening 108 is generally closed off by the body 102 in this embodiment, with the body 102 generally surround the post opening 108. As can be appreciated, the post opening 108 allows the collar 100 to be positioned over an end (e.g., a top end, etc.) of the post, and then moved along the post (e.g., up and down, etc.) to a desired location. Although FIGS. 1-4 illustrate the main portion 110 of the post opening 108 as having a generally square shape, and the slot 112 as extending from a center of one side of the main portion 110, other embodiments may include collars having post openings (and slots) with any other suitable shapes and/or configurations.

The lower portion 106 of the collar 100 includes a tool receiver 114 for coupling a tool to the collar 100 (e.g., for use with the collar 100 to drive posts into the ground or to remove posts from the ground, etc.). In the illustrated collar 100, the tool receiver 114 includes an opening defined through (extending completely through) the body 102 (at the lower portion 106) of the collar 100 and shaped to correspond to a tip of a driving tool, so that in use the tip may extend into the tool receiver 114. With that said, it should be appreciated that the opening of the tool receiver 114 need not extend completely through the lower portion 106 of the body 102. In addition, in other embodiments, collars may include tool receivers with other configurations (e.g., depending on tools to be used with the collars for driving posts or removing posts, etc.).

With continued reference to FIGS. 1-4, the upper portion 104 of the collar 100 (e.g., a plane of the upper portion 104, etc.) defines an obtuse angle 116 (FIG. 3) with the lower portion 106 of the collar 100 (e.g., with a plane of the lower portion 106, etc.), such that the upper portion 104 and the lower portion 106 are not coplanar. In the illustrated embodiment, the angle 116 defined by the upper and lower portions 102, 104 of the collar 100 is approximately 125 degrees. However, in other exemplary embodiments, collars may include upper and lower portions that define other angles within the scope of the present disclosure (e.g., angles between about 45 degrees to about 180 degrees, etc.).

With reference now to FIGS. 5-8, use of the collar 100 in a first orientation to drive a T-post 118 into the ground will be described next.

The collar 100 is initially positioned over an end portion of the T-post 118 with the upper portion 104 of the collar 100 positioned generally perpendicular to the T-post 118 (e.g., to a longitudinal axis of the T-post 118, etc.). The slot 112 of the post opening 108 generally aligns with a rib extension 120 of the T-post 118, and the main portion 110 of the opening 108 generally aligns with a flange 122 and studs 124 of the T-post 118. The collar 100 is then moved onto the T-post 118, with the flange 122 and studs 124 extending through the main portion 110 of the opening 108 and with the rib extension 120 extending through the slot 112. The collar 100 can then be moved (e.g., slid, etc.) along the T-post 118 (e.g., up and down, etc.) to a desired location.

Once the collar is at a desired location along the T-post 118, the collar 100 is set (or secured) against the T-post 118 by rotating or pushing the lower portion 106 of the collar 100 down (e.g., clockwise in FIG. 5, etc.) and positioning a side 126 (generally opposite the slot 112) of the upper portion 104 of the collar 100 generally between adjacent studs 124 of the T-post 118. In so doing, the upper portion 104 of the collar 100 (and the side 126, for example) moves into engagement with the flange 122 of the T-post 118 and with one of the studs 124 (such that the main portion 110 of the post opening 108 is generally coupled over the flange 122 and stud 124 of the T-post 118). The upper portion 104 also moves into engagement with the rib extension 120 of the T-post 118 (such that the slot 112 of the post opening 108 is generally coupled over the rib extension 120 of the T-post 118). And, the lower portion 106 of the collar is substantially perpendicular to the T-post 118 (e.g., to the longitudinal axis of the T-post 118, etc.). In this position, the collar 100 is inhibited from moving further down the T-post 118 generally due to the positioning of the collar 100 between the studs 124, and the skewed (or angled) contact between the collar 100 and the T-post 118, i.e., the contact between the side 126 of the collar 100 with the flange 122 of the T-post 118 and the contact between the collar 100 at the slot 112 and the rib extension 120 of the T-post 118 (e.g., which generates a torque force (clockwise in FIG. 5) and friction force that tends to help hold, or pinch, the collar 100 on the T-post 118; etc.). What's more, in some embodiments, an edge of the side 126 and/or an edge of the slot 112 of the collar 100 may be configured (e.g., may be generally sharp, etc.) to bite into the T-post 118 to further help hold the collar 100 on the T-post 118 (particularly when the collar 100 is formed from a material that is generally harder that a material from which the T-post is formed).

Next, a jackhammer bit 128 (broadly, a tool) is coupled to the collar 100, via the tool receiver 114 of the lower portion 106 (specifically, via the opening defined by the tool receiver 114). The jackhammer bit 128 may be coupled to the collar 100 prior to coupling the collar 100 to the T-post 118. Or, the jackhammer bit 128 may be couple to the collar 100 after coupling the collar 100 to the T-post 118. In either case, a jackhammer 130 (FIGS. 7 and 8) can then be coupled to the jackhammer bit 128 and used to impart a driving force to the collar 100 and the T-post 118. Further, in some applications, the jackhammer bit 128 may be coupled to the jackhammer 130 first, and then coupled to the collar 100 and used to impart the driving force to the collar 100 and the T-post 118. With that said, because the collar 100 is inhibited from moving down the T-post 118 (as described above), applying the driving force to the collar 100 drives the T-post 118 downward and into the ground. As needed, the collar 100 can then be adjusted upward along the T-post 118 (as many times as needed) to provide additional room for a user to continue operating the jackhammer 130 to drive the T-post 118, until the T-post 118 is at a desired depth in the ground.

While the jackhammer bit 128 and the jackhammer 130 are described as being used with the collar 100 to drive the T-post 118 into the ground, it should be appreciated that other suitable driving tools may be used. For example, pneumatic driving tools, electric driving tools, hydraulic driving tools, breaker hammers, backhoes, loaders, excavators, etc. may be used to provide a driving force to move the T-post 118 into the ground.

As can be seen in FIGS. 5-8, the driving force provided by the jackhammer 130, through the jackhammer bit 128, is in a direction along a longitudinal axis of the jackhammer bit 128 that is offset to the longitudinal axis of the T-post 118. This allows the jackhammer 130 to be used (and the driving force to be applied) next to the T-post 118, without interference from the T-post 118. This also allows use of the jackhammer 130 (and application of the driving force) at a lower location along the T-post 118, which may make driving the T-post 118 into the ground more convenient (as the user need not access the top of the T-post 118 to apply the driving force, which can often be difficult with heavy tools or which may result in bending of the T-post 118 during the driving operation) and more efficient (e.g., the T-post 118 may be driven into the ground straighter, etc.).

Figure 7:
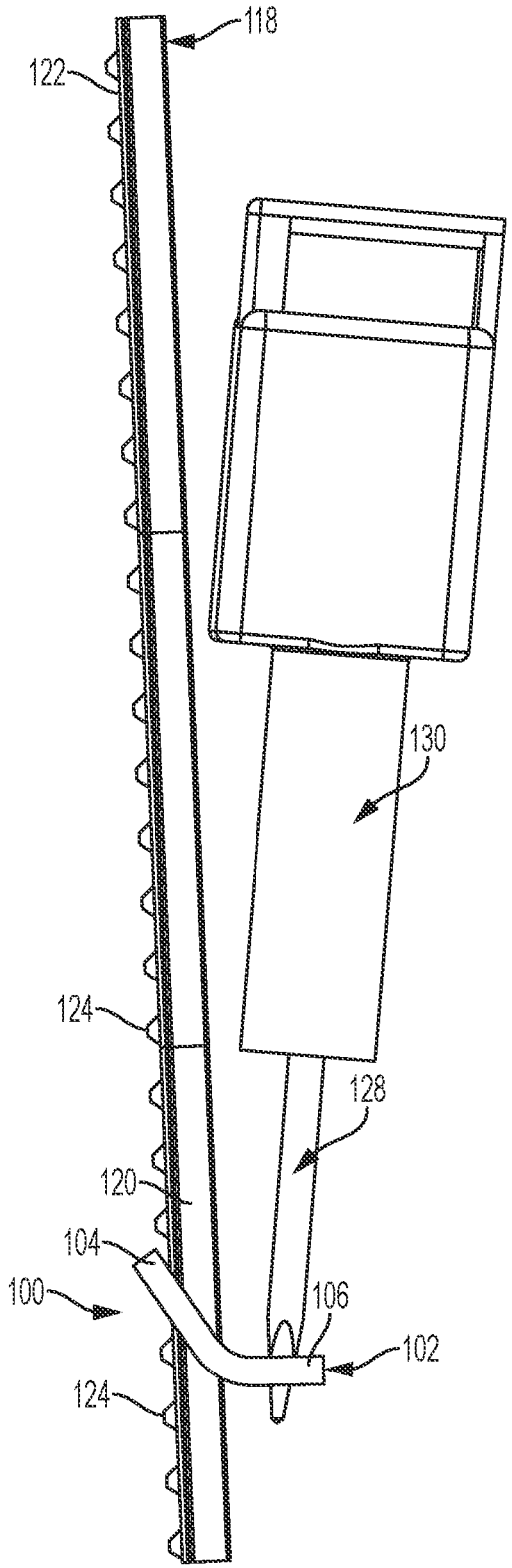
FIG. 7 is the side view of FIG. 5, with a jackhammer shown coupled to the driving tool.
Figure 8:
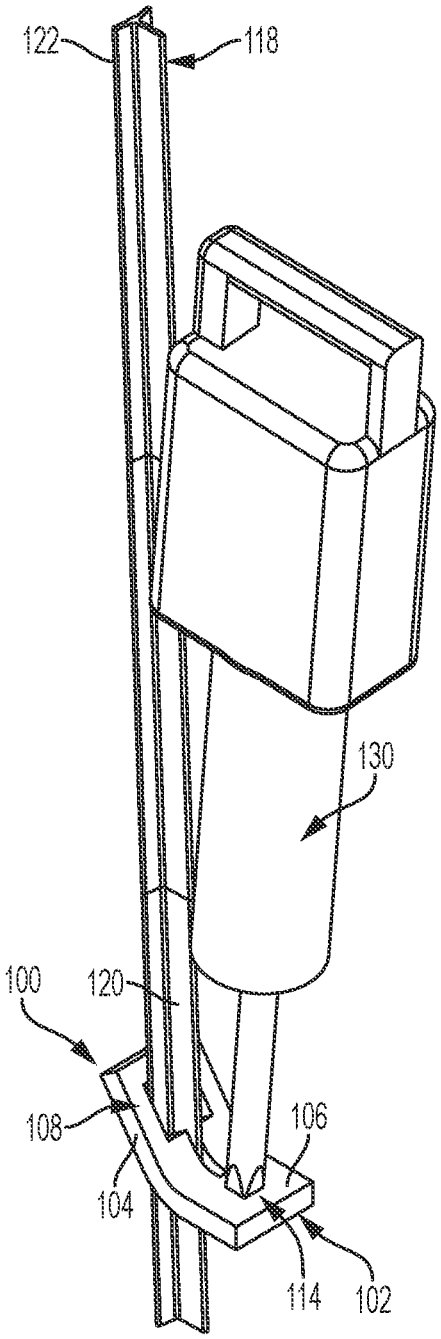
FIG. 8 is a perspective view of the assembly of FIG. 7.

In addition in the illustrated embodiment, the driving force provided by the jackhammer 130, through the jackhammer bit 128, is in a direction that is at an angle to the longitudinal axis of the T-post 118 (although this is not required in all embodiments). As can be seen in FIGS. 7 and 8, this is due to the angled positioning of the jackhammer 130 adjacent the T-post 118 when driving the T-post 118 in the ground. With that said, it should be appreciated that in other embodiments, the driving force may be provided in a direction that is generally parallel to the longitudinal axis of the T-post 118 (e.g., when different driving tools are used, when differently sized collars are used, etc.).

Once the T-post 118 is driven sufficiently into the ground, the jackhammer 130 and jackhammer bit 128 can be removed from the collar 100. The collar 100 can then be removed from the T-post 118 by rotating or pushing the lower portion 106 of the collar 100 up (e.g., counterclockwise in FIG. 7, etc.), and then sliding the collar 100 generally up the T-post 118.

With further reference to FIGS. 9-12, use of the collar 100 in a second orientation to remove a T-post (also indicated at reference number 118 in the drawings) from the ground will be described next. In the second orientation, of the collar 100 is rotated about 180 degrees relative to the first orientation.

The collar 100 is initially positioned over an end portion of the T-post 118, with the upper portion 104 of the collar 100 positioned generally perpendicular to the T-post 118 (e.g., to a longitudinal axis of the T-post 118, etc.). The slot 112 of the post opening 108 generally aligns with a rib extension 120 of the T-post 118, and the main portion 110 of the opening 108 generally aligns with a flange 122 and studs 124 of the T-post 118. The collar 100 is then moved onto the T-post 118, with the flange 122 and studs 124 extending through the main portion 110 of the opening 108 and with the rib extension 120 extending through the slot 112. The collar 100 can then be moved (e.g., slid, etc.) along the T-post 118 (e.g., up and down, etc.) to a desired location.

Once the collar is at a desired location along the T-post 118, the collar 100 is set (or secured) against the T-post 118 by rotating or pushing the lower portion 106 of the collar 100 up (e.g., counter-clockwise in FIGS. 9-12, etc.) and positioning side 126 (generally opposite the slot 112) of the upper portion 104 of the collar 100 generally between adjacent studs 124 of the T-post 118. In so doing, the upper portion 104 of the collar 100 moves into engagement with the flange 122 of the T-post 118 and with one of the studs 124 (such that the main portion 110 of the post opening 108 is generally coupled over the flange 122 and stud 124 of the T-post 118). The upper portion 104 also moves into engagement with the rib extension 120 of the T-post 118 (such that the slot 112 of the post opening 108 is generally coupled over the rib extension 120 of the T-post 118). And, the lower portion 106 of the collar is substantially perpendicular to the T-post 118 (e.g., to the longitudinal axis of the T-post 118, etc.). In this position, the collar 100 is again inhibited from moving further down the T-post 118 generally due to the positioning of the collar 100 between the studs 124, and the skewed (or angled) contact between the collar 100 and the T-post 118, i.e., the contact between the side 126 of the collar 100 with the flange 122 of the T-post 118 and the contact between the collar 100 at the slot 112 and the rib extension 120 of the T-post 118 (e.g., which generates a torque force (counter-clockwise in FIGS. 9-12) that tends to help hold, or pinch, the collar 100 on the T-post 118; etc.).

Next, a removal tool is coupled to the collar 100 at the lower portion 106. The removal tool can then be operated to impart a generally upward extracting force to the collar 100 and the T-post 118. Because the collar 100 is inhibited from moving up the T-post 118 (i.e., when the collar is secured to the T-post 118, as described above), applying the extracting force to the collar 100 pushes the T-post 118 upward and out of the ground. As needed (and as described in connection with using the collar 100 to drive the T-post 118 into the ground), the collar 100 can be adjusted downward along the T-post 118 (as many times as needed) to provide additional room for a user to continue operating the removal tool to apply the extracting force, until the T-post 118 is completely out of the ground.

Figure 9:
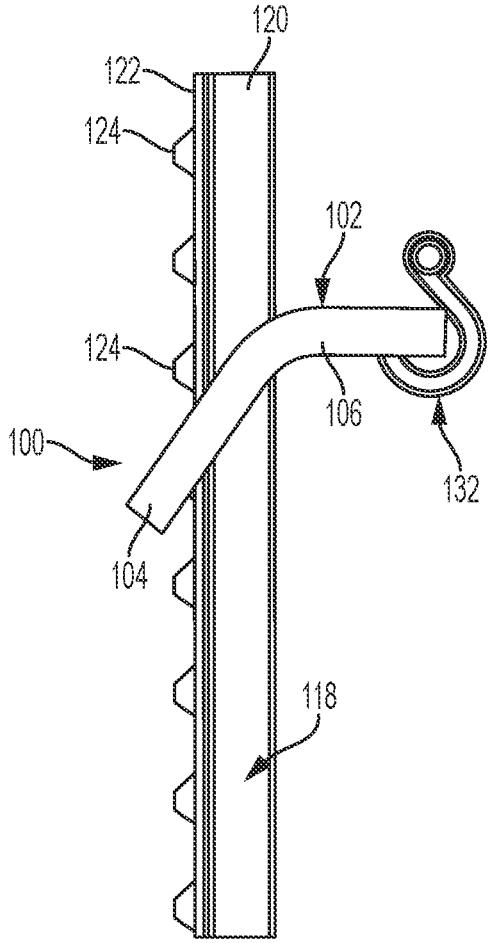
FIG. 9 is a side view of the collar of FIG. 1, with the first portion of the collar shown installed to a T-shaped post in a second orientation and with a hook shown coupled to the second portion of the collar for use in removing the T-shaped post from the ground.
Figure 10:
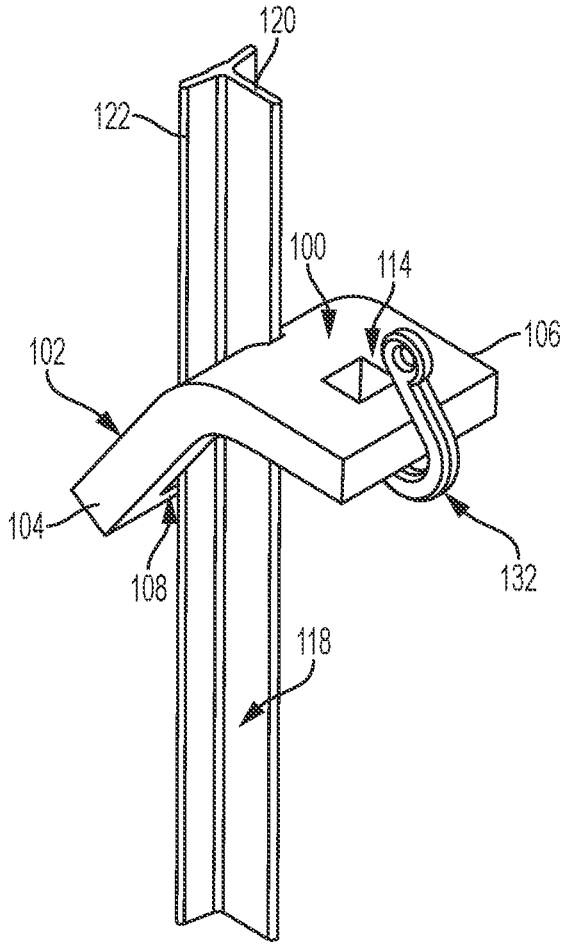
FIG. 10 is a perspective view of the assembly of FIG. 9.
Figure 11:
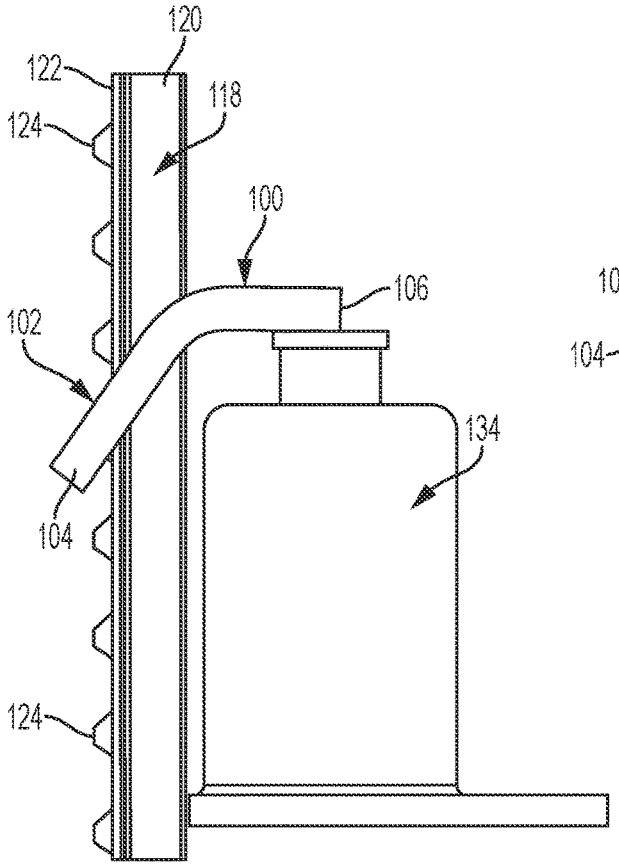
FIG. 11 is a side view of the collar of FIG. 1, with the first portion of the collar shown installed to a T-shaped post in the second orientation and with a jack shown coupled to the second portion of the collar for use in removing the T-shaped post from the ground.
Figure 12:
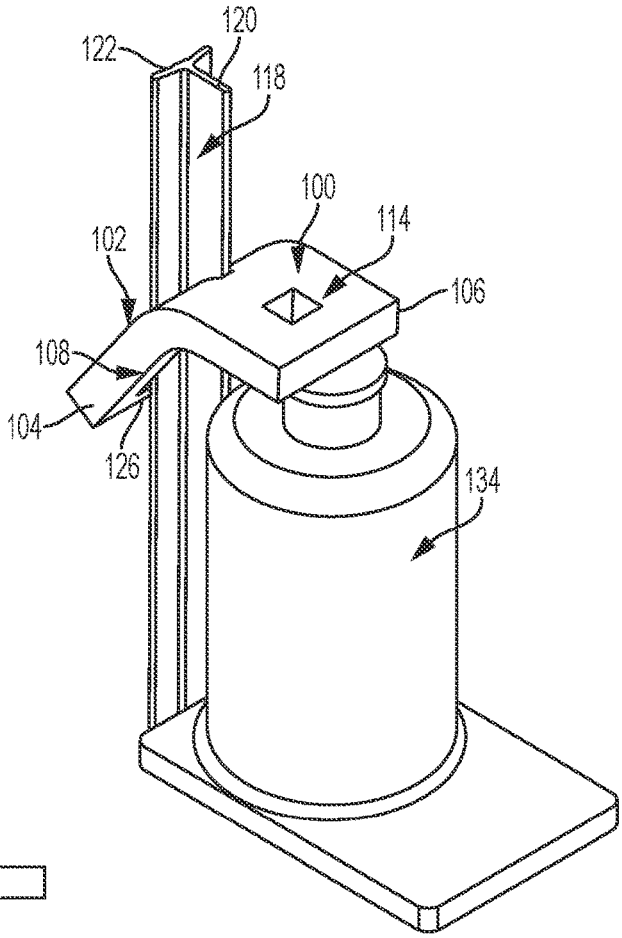
FIG. 12 is a perspective view of the assembly of FIG. 11.
Figure 13:
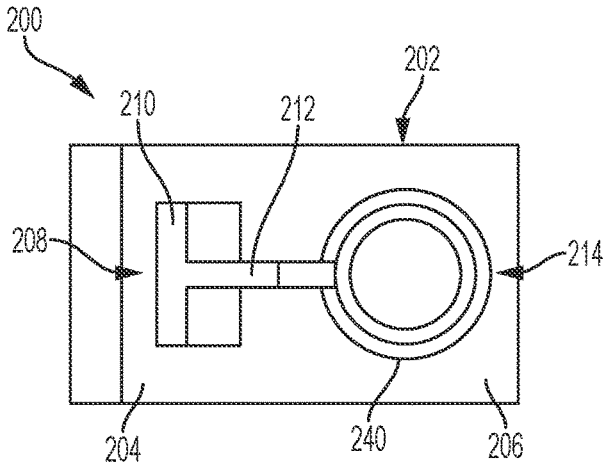
FIG. 13 is a top view of another exemplary embodiment of a collar according to the present disclosure and suitable for use in either driving posts into the ground or removing posts from the ground.
Figure 14:
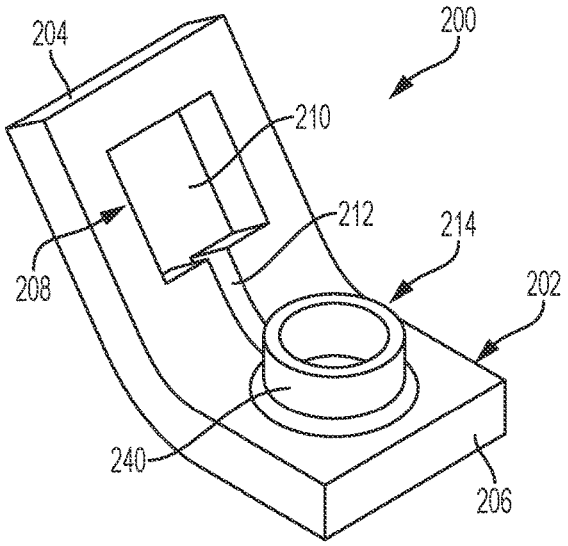
FIG. 14 is a perspective view of the collar of FIG. 13.
Figure 15:
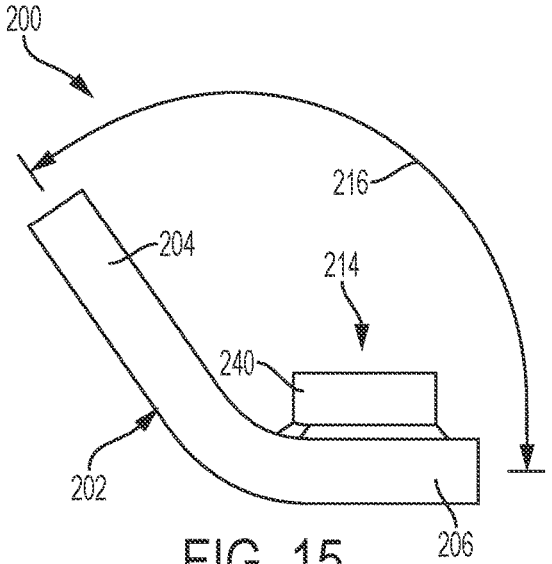
FIG. 15 is a side view of the collar of FIG. 13.
Figure 16:
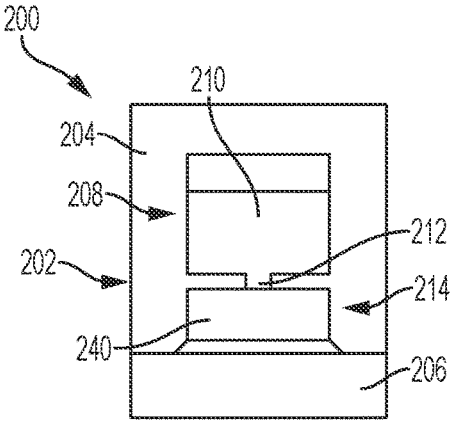
FIG. 16 is a front view of the collar of FIG. 13.

As an example, in FIGS. 9 and 10 the removal tool includes a hook 132 configured to couple to the lower portion 106 of the collar 100 via the opening of the tool receiver 114. Once attached, the hook 132 may then be pulled upward (e.g., via a pulley system, via a loader, etc.) to apply an extracting force to the collar 100 to remove the T-post 118 from the ground. And, in FIGS. 11 and 12, the removal tool includes a jack 134 configured to couple to (e.g., be positioned into engagement with, etc.) a lower surface of the lower portion 106 of the collar 100. The jack 134 can then be extended to press up on the collar 100 and apply an extracting force to remove the T-post 118 from the ground. It should be appreciated that any suitable hook and/or jack may be used in connection with applying an extracting force on the collar for removing the T-post 118 from the ground. For example, the jack may include a pneumatic jack, a hydraulic jack, a manual jack, etc. It should also be appreciated that any suitable removal tool may be used, other than hooks and jacks, for example forks of a fork lift, a bucket of a loader, etc.

As with the driving force imparted by the jackhammer 130 described above, the extracting force imparted by the removal tool is provided generally in a direction along an axis that is offset to the longitudinal axis of the T-post 118. This allows the removal tool to be used (and the extracting force to be applied) next to the T-post 118, without interference from the T-post 118. This also allows use of the removal tool (and application of the extracting force) at a lower location along the T-post 118, which may make removing the T-post 118 easier and more efficient (particularly when the removal tool includes the jack 130). As such, a user need not apply the removing force to the top of the T-post, which can be difficult to reach or access and gain leverage.

Once the T-post 118 is removed from the ground, the removal tool can be uncoupled from the collar 100. The collar 100 can then be removed from the T-post 118 by rotating or pushing the lower portion 106 of the collar 100 down (e.g., clockwise in FIGS. 9-12, etc.), and then sliding the collar 100 generally up (or down) the T-post 118.

As can be seen, the collar 100 may be used in any suitable fashion to drive posts into the ground, and to remove posts from the ground. In addition, the collar 100 may easily and quickly be placed about the posts and positioned as desired. Driving forces or extracting forces (depending on the orientation of the collar 100 and the desired use) can then be applied to collar 100 to either drive a post into the ground or remove a post from the ground. The collar 100 can then be removed from the post when done, or moved to a different location along the post as needed to continue the driving or removing operation.

FIGS. 13-18 illustrate another exemplary embodiment of a collar 200 including one or more aspects of the present disclosure. The collar 200 can be used to drive posts (e.g., T-post 218, etc.) into the ground, and can also be used to remove posts from the ground.

The collar 200 of this embodiment is substantially similar to the collar 100 previously described with reference to FIGS. 1-12. For example, the collar 200 generally includes a body 202 having an upper portion 204 and a lower portion 206. The upper portion 204 of the collar 200 includes a post opening 208 having a main portion 210 and a slot 212. And, the upper portion 204 of the collar 200 (e.g., a plane of the upper portion 204, etc.) defines an obtuse angle 216 (FIG. 15) with the lower portion 206 of the collar 200 (e.g., with a plane of the lower portion 206, etc.), such that the upper portion 204 and the lower portion 206 are not coplanar. In addition, the collar 200 can be coupled to the T-post 218 in the same manner previously described for coupling collar 100 to T-post 118, and then also used in a similar manner to collar 100 for either driving the T-post 218 into the ground or removing the T-post 218 from the ground.

Figure 17:
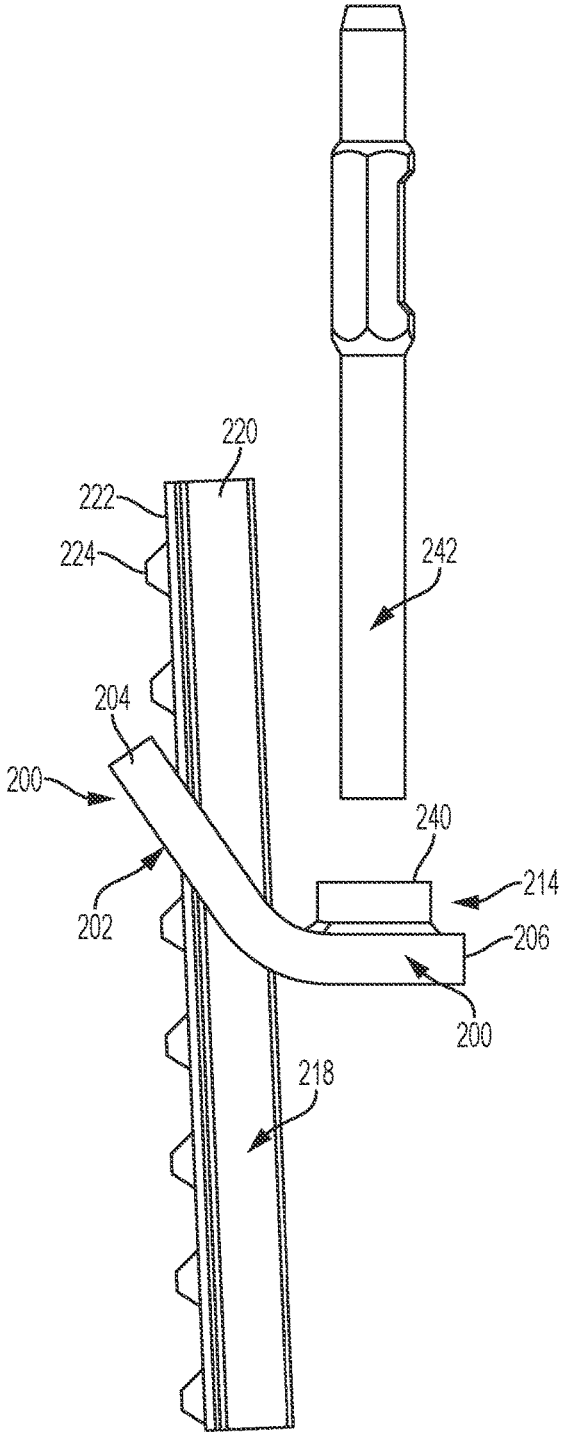
FIG. 17 is a side view of the collar of FIG. 13, with a first portion of the collar shown installed to a T-shaped post and with a driving tool shown coupled to a second portion of the collar for use in driving the T-shaped post into the ground.
Figure 18:
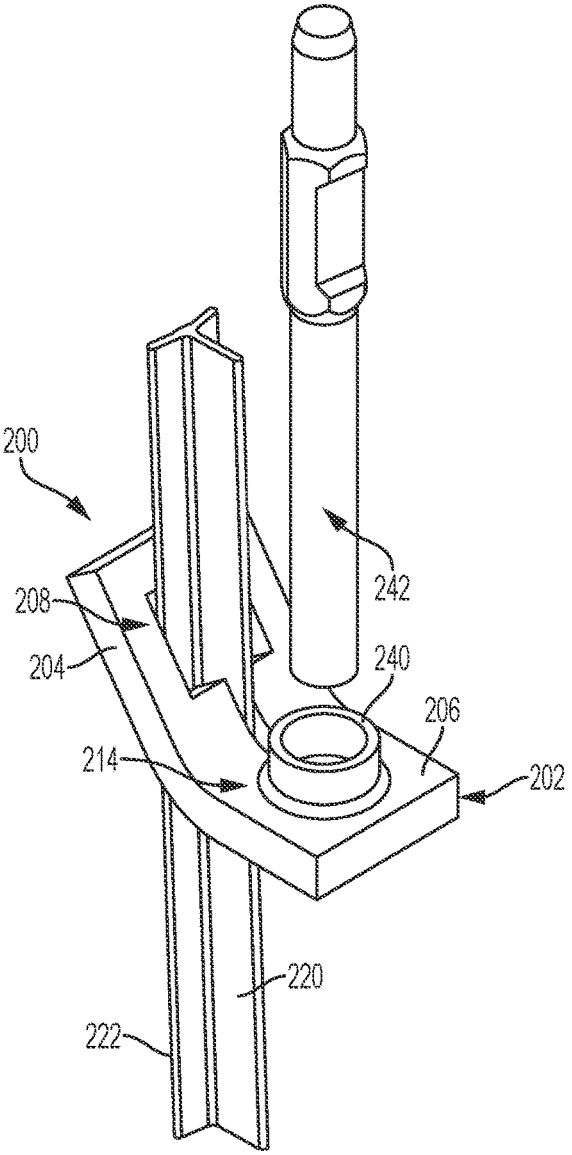
FIG. 18 is a perspective view of the assembly of FIG. 17.
Figure 19:
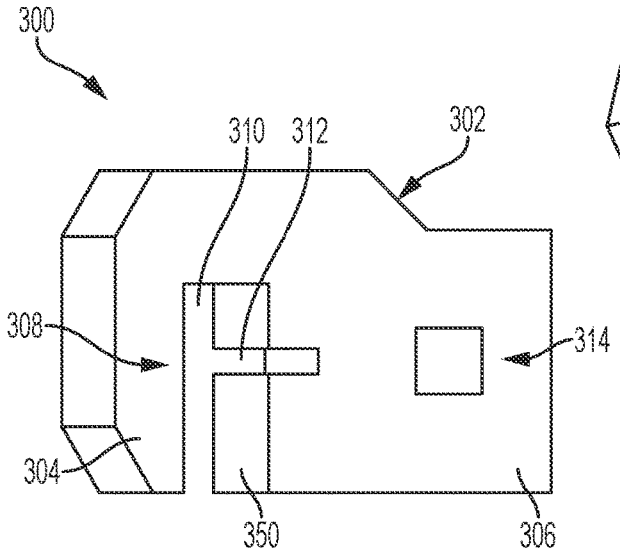
FIG. 19 is a top view of another exemplary embodiment of a collar according to the present disclosure and suitable for use in either driving posts into the ground or removing posts from the ground.
Figure 20:
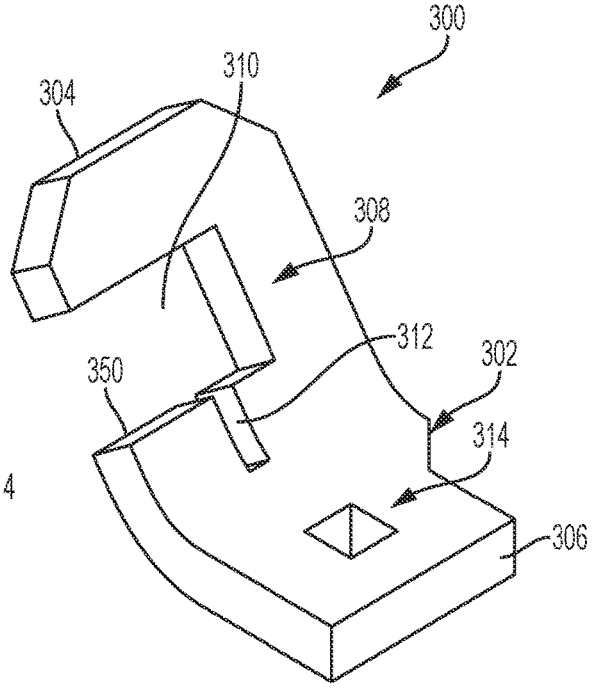
FIG. 20 is a perspective view of the collar of FIG. 19.
Figure 21:
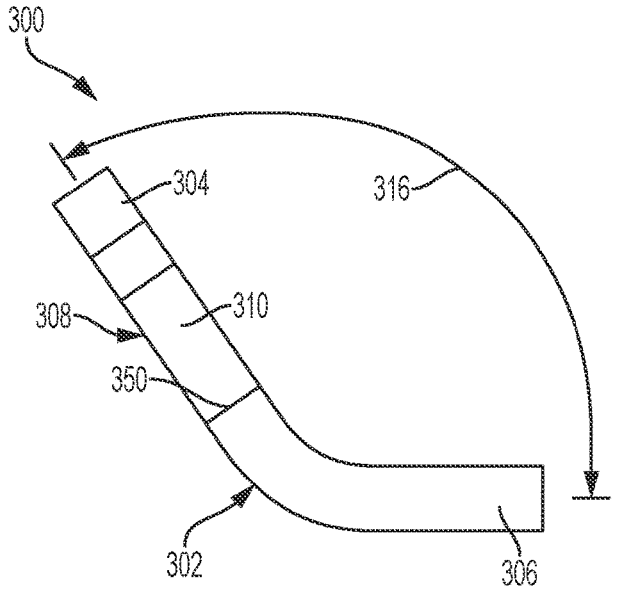
FIG. 21 is a side view of the collar of FIG. 19.
Figure 22:
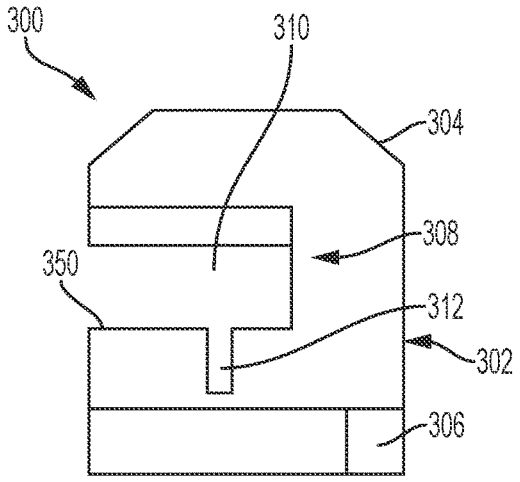
FIG. 22 is a front view of the collar of FIG. 19.
Figure 23:
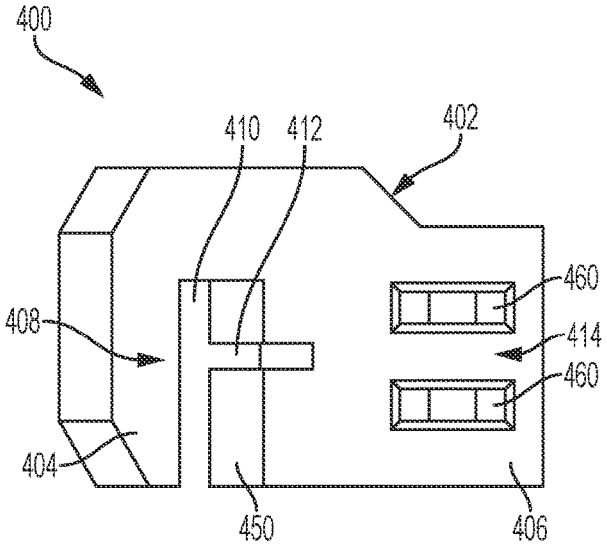
FIG. 23 is a top view of still another exemplary embodiment of a collar according to the present disclosure and suitable for use in either driving posts into the ground or removing posts from the ground.
Figure 24:
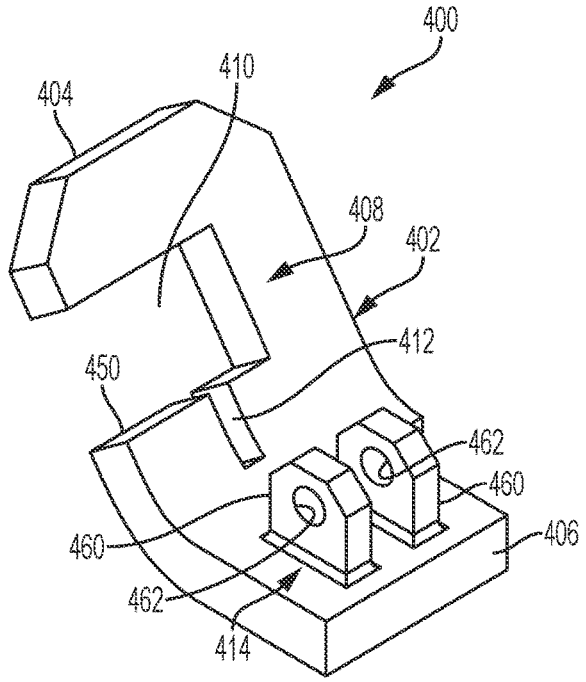
FIG. 24 is a perspective view of the collar of FIG. 23.
Figure 25:
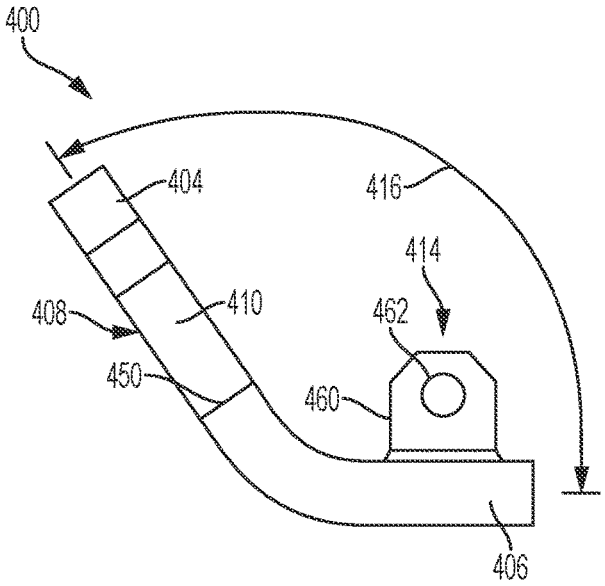
FIG. 25 is a side view of the collar of FIG. 23.
Figure 26:
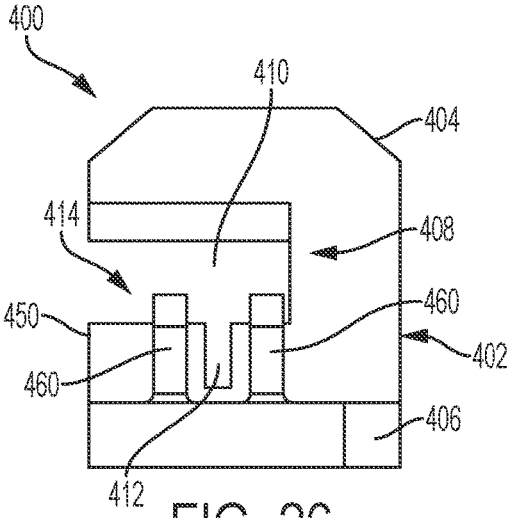
FIG. 26 is a front view of the collar of FIG. 23.
Figure 27:
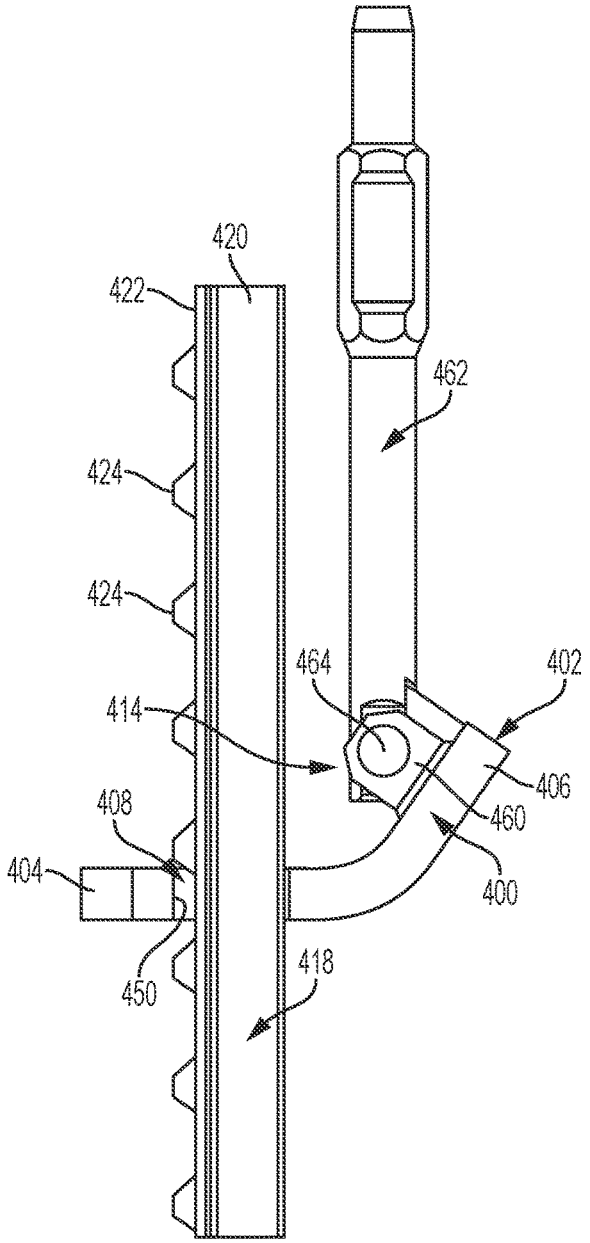
FIG. 27 is a side view of the collar of FIG. 23 illustrating installation of the collar to a T-shaped post.
Figure 28:
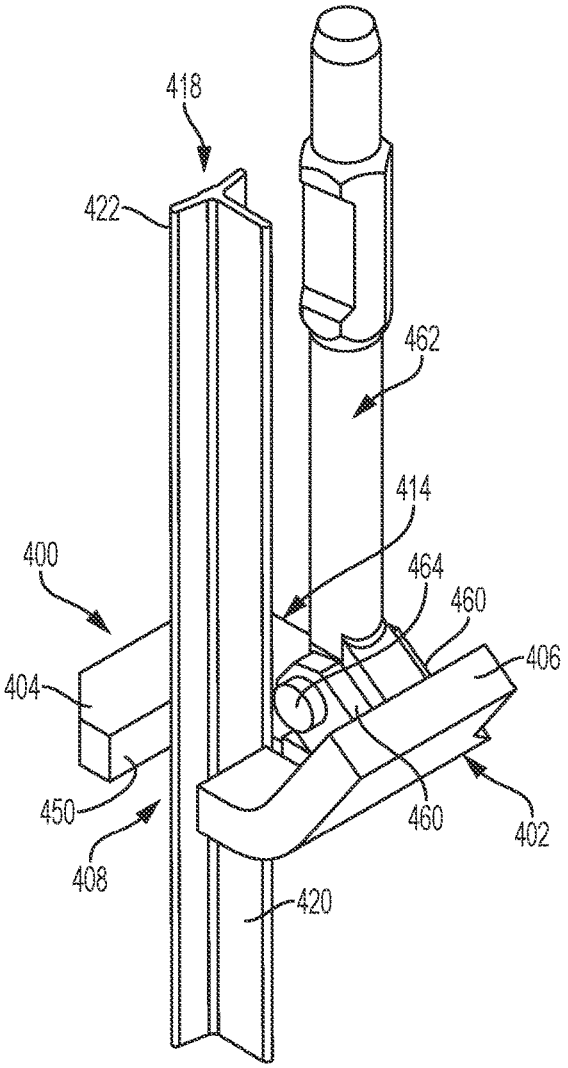
FIG. 28 is a perspective view of the assembly of FIG. 27.
Figure 29:
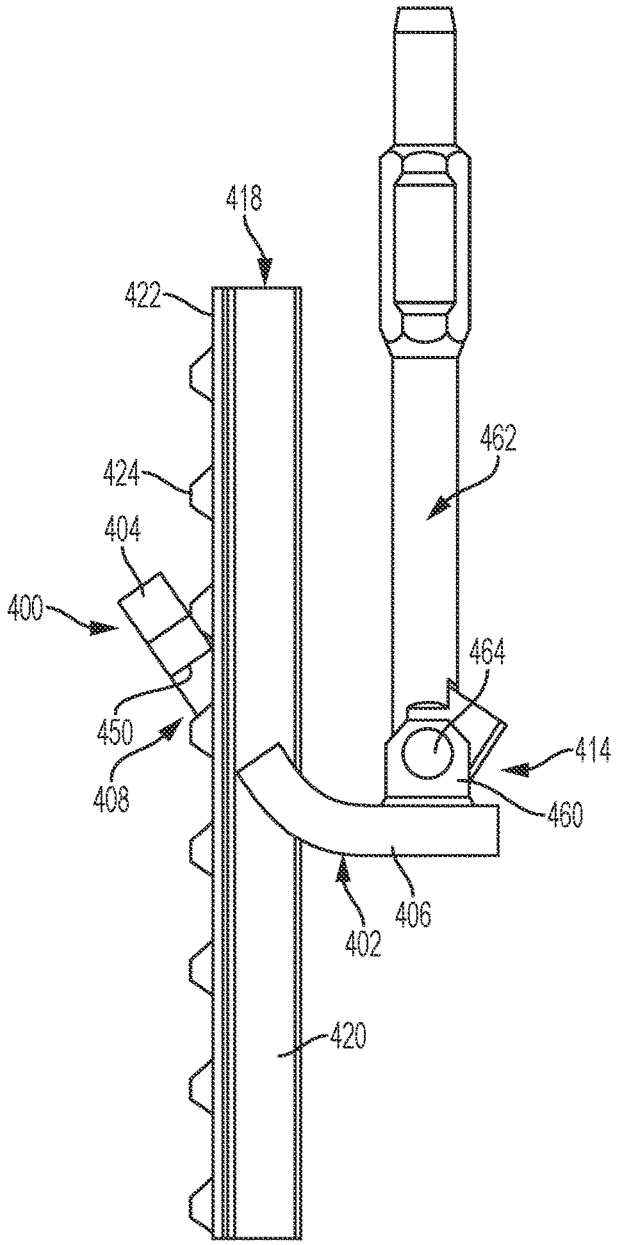
FIG. 29 is the side view of FIG. 27, with the collar shown installed to the T-shaped post and engaging a stud of the T-shaped post.
Figure 30:
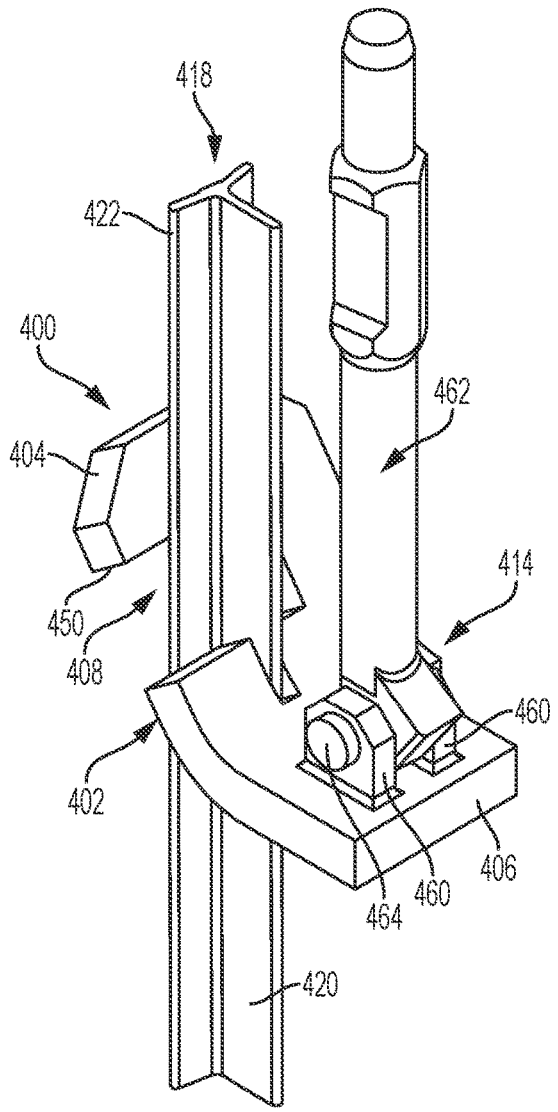
FIG. 30 is a perspective view of the assembly of FIG. 29.

In this embodiment, the lower portion 206 of the collar 200 includes a tool receiver 214 that comprises a cylinder 240. The cylinder 240, in this embodiment, is adapted to receive a jackhammer bit 242 having a generally flat tip, as shown in FIGS. 17 and 18. In particular, the cylinder 240 defines an opening (that does not extend through the body 202 of the collar 200 at the lower portion 206) having a diameter that generally matches a diameter of the tip of the jackhammer bit 242. A jackhammer (similar to jackhammer 130) can then be coupled to the jackhammer bit 242 and used to drive the T-post 218 into the ground.

FIGS. 19-22 illustrate another exemplary embodiment of a collar 300 including one or more aspects of the present disclosure. The collar 300 can be used to drive posts (e.g., T-posts, etc.) into the ground, and can also be used to remove posts from the ground.

The collar 300 of this embodiment is substantially similar to the collar 100 previously described with reference to FIGS. 1-12. For example, the collar 300 generally includes a body 302 having an upper portion 304 and a lower portion 306. The upper portion 304 of the collar 300 includes a post opening 308 having a main portion 310 and a slot 312. The lower portion 304 includes a tool receiver 314 generally defined by an opening extending through the body 302 (e.g., for receiving a jackhammer bit such as jackhammer bit 128, etc.). In addition, the upper portion 304 of the collar 300 (e.g., a plane of the upper portion 304, etc.) defines an obtuse angle 316 (FIG. 21) with the lower portion 306 of the collar 300 (e.g., with a plane of the lower portion 306, etc.), such that the upper portion 304 and the lower portion 306 are not coplanar. Further in this embodiment, the collar 300 can be secured to a T-post in the same manner previously described for coupling collar 100 to T-post 118, and then also used in a similar manner to collar 100 for either driving the T-post into the ground or removing the T-post from the ground.

In this embodiment, the upper portion 304 of the collar 300 includes a cutout 350 at the post opening 308 that allows the collar 300 to be placed about a T-post from a side of the T-post (instead of requiring the collar 300 to be placed over an end of the T-post, although this could still be done). In particular, when desired to couple the collar 300 to a T-post, the collar 300 is slid onto the T-post such that the T-post passes through the cutout 350 and into the post opening 308. As can be appreciated, this construction of collar 300 (having the cutout 350) can be advantageous in coupling the collar 300 to a T-post in applications where an end portion of the T-post is not accessible or is obstructed.

FIGS. 23-30 illustrate still another exemplary embodiment of a collar 400 including one or more aspects of the present disclosure. The collar 400 can be used to drive posts (e.g., T-post 418, etc.) into the ground, and can also be used to remove posts from the ground.

The collar 400 of this embodiment is substantially similar to the collar 100 previously described with reference to FIGS. 1-12. For example, the collar 400 generally includes a body 402 having an upper portion 404 and a lower portion 406. The upper portion 404 of the collar 400 includes a post opening 408 having a main portion 410 and a slot 412. And, the upper portion 404 of the collar 400 (e.g., a plane of the upper portion 404, etc.) defines an obtuse angle 416 (FIG. 25) with the lower portion 406 of the collar 400 (e.g., with a plane of the lower portion 406, etc.), such that the upper portion 404 and the lower portion 406 are not coplanar. In addition, the collar 400 can be secured to the T-post 418 in the same manner previously described for coupling collar 100 to T-post 118, and then also used in a similar manner to collar 100 for either driving the T-post 418 into the ground or removing the T-post 418 from the ground.

In this embodiment, the upper portion 404 of the collar 400 includes a cutout 450 at the post opening 408 that allows the collar 400 to be placed about the T-post 418 from a side of the T-post 418 (instead of requiring the collar 400 to be placed over an end of the T-post 418, although this could still be done). In particular, when desired to couple the collar 400 to the T-post 418, the collar 400 is slid onto the T-post 418 such that the T-post 418 passes through the cutout 450 and into the post opening 408. As can again be appreciated, this construction of collar 400 (having the cutout 450) can be advantageous in coupling the collar 400 to the T-post 418 in applications where the end portion of the T-post 418 is not accessible or is obstructed.

Also in this embodiment, the lower portion 406 of the collar 400 includes a tool receiver 414 that comprises mounts 460 extending generally away from the body 402. The mounts 460, in this embodiment, are adapted to receive a jackhammer bit 462 between the mounts 460, as shown in FIGS. 27-30. The jackhammer bit 462 is then adapted to couple to the mounts 460 via a fastener 464 positioned through generally aligned holes 466 of the mounts 460 and a corresponding hole of the jackhammer bit 462 (that generally aligns with the holes 466 when the jackhammer bit 462 is coupled to the collar 400). The holes 466 of the mounts 460 are oriented such that longitudinal axes of the holes are generally parallel (and generally coincide) and are generally perpendicular to a thickness of the lower portion 406. A jackhammer (similar to jackhammer 130) can then be coupled to the jackhammer bit 462 and used to drive the T-post 418 into the ground.

As can be appreciated, the collar 400 of this embodiment allows a user to quickly and easily drive multiple posts, using a jackhammer, for example, coupled to the collar 400 (via the jackhammer bit 462) by selectively guiding the collar 400 onto and off of T-posts as they are being driven, without uncoupling the jackhammer from the collar 400. For example, the collar 400 can be slid onto a T-post via cutout 450 of the collar 400 (with the jackhammer already coupled to the collar 400), and secured (or set) to the T-post by simply pushing down on the jackhammer (as generally described above for collar 100). The jackhammer can then be operated to drive the T-post as desired. To adjust a location of the collar 400 along the T-post, the jackhammer can be raised up to release (or unsecure) the collar 400 from the T-post (as generally described above for collar 100) and then slid up (or down) to a new location. The collar 400 can then be re-secured to the T-post. Or, the collar 400 can be removed from the T-post via the cutout 450, and coupled to another T-post.

As described above, the collars (e.g., collars 100, 200, 300, 400, etc.) of the present disclosure may be used with any desired types of posts. While the collars are illustrated herein as being used with T-posts having studs, it should be appreciated that the collars can be used with other posts that may or may not have studs. When used with posts that do not have studs, frictional contact between the collars and the posts helps hold, or pinch, the collars on the posts.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that exemplary embodiments may be embodied in many different forms, and that neither should be construed to limit the scope of the disclosure. In some exemplary embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values are not exclusive of other values that may be useful in one or more of the examples disclosed herein.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Spatially relative terms, such as "inner," "outer," "beneath," "below," "lower," "above," "upper," "left,", "right" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With that said, the foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A collar for use with posts, the collar comprising:

a body having a first portion and a second portion;

wherein the first portion defines a post opening adapted for coupling about a post;

wherein the second portion is coupled to the first portion, the second portion having a cylinder adapted for receiving a tool for use in driving the post when the first portion is coupled about the post;

wherein an upper surface of the first portion defines an obtuse angle with respect to an upper surface of the second portion;

wherein the cylinder extends away from the upper surface of the second portion and into the obtuse angle defined by the upper surface of the first portion and the upper surface of the second portion, the cylinder defining an opening adapted for receiving the tool for use in driving the post into the ground when the first portion is coupled about the post.

2. The collar of claim 1, wherein the first portion and the second portion are integral.

3. The collar of claim 1, wherein the post opening of the first portion includes a slot extending generally toward the second portion.

4. The collar of claim 3, wherein the post opening of the first portion is adapted to couple about a T-shaped post, with the slot of the post opening adapted to couple about a rib extension of the T-shaped post.

5. The collar of claim 4, wherein the first portion includes a side disposed generally opposite the slot of the post opening, the side adapted to engage a stud of the T-shaped post for use in coupling the first portion about the T-shaped post.

6. The collar of claim 3, wherein the collar extends entirely around the opening of the first portion.

7. The collar of claim 1, wherein the tool includes a jackhammer bit; and wherein the opening defined by the cylinder is adapted for coupling the jackhammer bit to the second portion for use in driving the post into the ground when the first portion is coupled about the post.

8. The collar of claim 7, wherein the opening defined by the cylinder is also adapted for receiving a tool for use in removing the post from the ground, when the first portion is coupled about the post.

9. The collar of claim 7, wherein the opening does not extend through the second portion.

10. The collar of claim 1, wherein the obtuse angle defined by the upper surface of the first portion and the upper surface of the second portion is adapted so that, when the first portion is coupled about the post, an axis of the tool along which a force is applied for use in driving the post into the ground is offset from a longitudinal axis of the post.

11. The collar of claim 10, wherein the obtuse angle defined by the upper surface of the first portion and the upper surface of the second portion is adapted so that the axis of the tool, when received by the cylinder of the second portion, and the longitudinal axis of the post are not parallel.

12. The collar of claim 10, wherein the obtuse angle defined by the upper surface of the first portion and the upper surface of the second portion is about 125 degrees.

13. An assembly comprising the collar of claim 1 and the tool; and wherein the tool includes a jackhammer bit.

* * * * *